219-121
7/31/79 AR 4,163,071 SR

United States Patent [19]
Weatherly et al.

[11] 4,163,071
[45] Jul. 31, 1979

[54] METHOD FOR FORMING HARD WEAR-RESISTANT COATINGS

[75] Inventors: Merle H. Weatherly, Indianapolis; Robert C. Tucker, Jr., Brownsburg, both of Ind.

[73] Assignee: Union Carbide Corporation, New York, N.Y.

[21] Appl. No.: 812,704

[22] Filed: Jul. 5, 1977

[51] Int. Cl.[2] ..... B05D 3/06
[52] U.S. Cl. ..... 427/34; 219/121 P; 427/423
[58] Field of Search ..... 427/34, 423; 219/76, 219/121 P

[56] References Cited

U.S. PATENT DOCUMENTS

| | | | |
|---|---|---|---|
| 3,150,938 | 9/1964 | Pelton et al. | 427/423 |
| 3,493,415 | 2/1970 | Grisaffe et al. | 427/34 |
| 3,573,963 | 4/1971 | Maxwell | 427/34 |
| 3,719,519 | 3/1973 | Perugini | 427/34 |

OTHER PUBLICATIONS

Ingham et al., *Metco Flame Spray Handbook*, vol. III, Metco Inc., New York, 1965, pp. 24–29.
Dorozhkin et al., "Poroshkovaya Metallurgiya", No. 12 (144), pp. 51–56 Dec. 1974.

*Primary Examiner*—John H. Newsome
*Attorney, Agent, or Firm*—Dominic J. Terminello

[57] ABSTRACT

A hard wear-resistant coating for a metallic substrate which is achieved by preheating the substrate to a temperature in the range of from 350° C. to 1000° C. and depositing the coating material with the plasma or detonation-gun (D-gun) process while maintaining the substrate within the 350° to 1000° temperature range to form a fine dispersion of carbide particles in the coating.

5 Claims, 4 Drawing Figures

FIG.2a
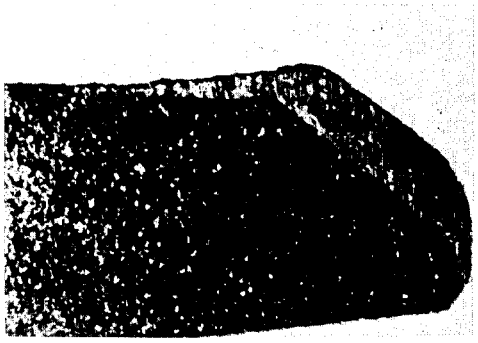
FIG. 2b
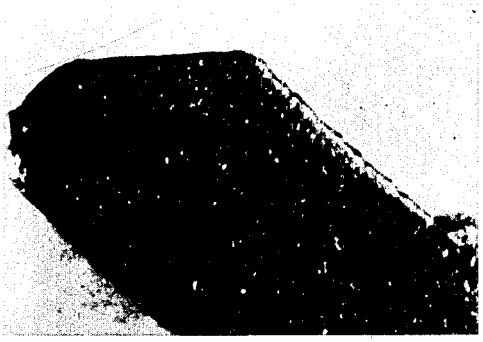
Plasma-deposited Stellite 6 as-coated and ground, approximately X10.
As-coated
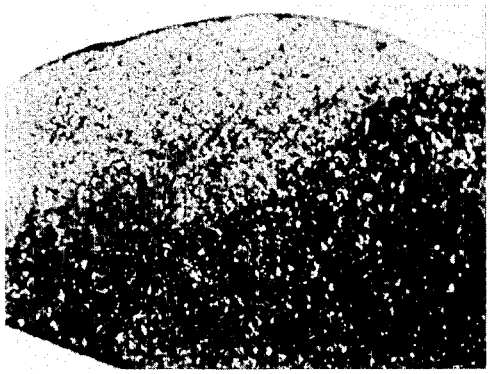
Ground
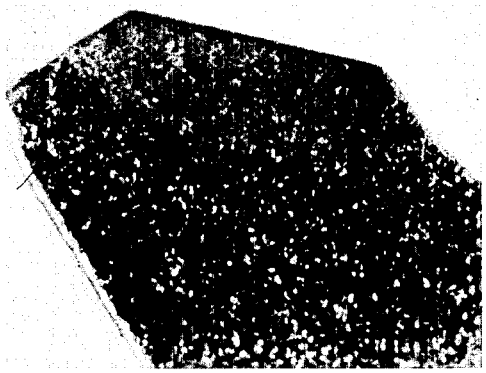
oxyacetylene flame sprayed Stellite 6 as-coated and ground, approximately X10.
FIG. 1a
FIG. 1b

METHOD FOR FORMING HARD WEAR-RESISTANT COATINGS

This invention relates to wear-resistant coatings deposited by the plasma or detonation-gun (D-gun) process and more particularly to such coatings deposited on a substrate which is preheated and maintained within the temperature range of 350°-1000° C. while such wear-resistant coating is deposited.

A wide variety of components in control devices (valves, orifices, etc.), machines (bearings, cylinders, pistons, etc.) and tools (jaw teeth, chucks, rolls, etc.) require surfaces that will withstand abrasive, adhesive, and erosive wear, often in a corrosive media. A specific example is an exhaust valve on an internal combustion engine which must endure high velocity, oxidizing gas flows (often containing carbonaceous particles) that cause severe erosion. Another example is the tip of a gas turbine blade that must withstand not only the hot corrosive gases, but the abrasive and adhesive wear caused by impact and rubbing against the engine casing. Industry has for years addressed these problems by applying hard wear-resistant layers to these components by such means as brazing inserts of hard materials to critical areas or applying hard coatings to the surfaces by detonation gun, plasma arc spraying (transferred and non-transferred), welding (gas or electric arc), electroplating, sputtering or ion plating. All of these suffer from certain limitations. The use of inserts is expensive and is not compatible with most application geometries. Detonation gun coatings provide some of the best coatings, but are limited in the thicknesses that can be applied, the geometries that can be addressed, and may be relatively expensive for some high volume applications. Sputtering and ion plating are even more expensive. Electroplating is very limited in the materials that can be effectively used, chromium probably being the hardest of those used for wear resistance.

Various welding techniques are commonly used to apply the general class of hard facing compositions. These materials have good wear resistance and can be applied in very thick layers. The method, however, differs from the preceding in that the hard facing material is fused on the surface of the substrate and always involves a significant amount of dilution with the substrate metal. This is a result of extensive mixing of the molten hard facing and the surface of the substrate. This, in effect, reduces the wear resistance of the deposit and wastes material. Additional material wastage occurs because the control of the process is limited and very rough surfaces are created, thus excessive amounts of material must often be removed by grinding before the component can be placed in service. Grinding costs are also high as a result. Transferred plasma arc methods of deposition are similar to other welding techniques, in that the surface and coating are fused, but because control of the process is better, less, but still a significant amount, of material is wasted through dilution and excessive roughness.

Non-transferred plasma arc coatings (hereinafter referred to simply as plasma coatings) can be applied in a very controlled manner, thus very little material is wasted. In this method of deposition the coating material, usually in the form of a powder, is melted and accelerated by the high velocity plasma gas stream and directed toward a substrate held at a temperature less than about 300° F. Upon striking the substrate, the particles freeze instantly without substantially heating the substrate. The bond between the coating and the substrate is thus primarily mechanical although some evidence of a very thin metallurgical reaction zone has been found for a few coatings such as molybdenum and tungsten. For many applications the deposition of a coating without significantly heating the substrate is a distinct advantage because the substrate can be heat treated to optimize its mechanical properties and machined to final dimensions without risking changes in properties or dimensions during coating deposition.

As each particle strikes the surface and freezes during plasma deposition, it generates a certain amount of residual stress. It is not as yet possible to calculate the residual stress to be expected from a given coating/substrate combination, but as a rough approximation, the thermal stresses generated can be thought of as resulting from first cooling the coating from its melting point to the temperature of the part during coating and then cooling the coated part to ambient temperatures.

This is, however, an over simplification, particularly since in each pass of the plasma torch heating of the surface by the plasma gas results in a transient temperature rise at the surface of the substrate (or coating if it is not the first coating pass) and the impacting powder particles provide probably an even greater transient temperature increase. Moreover, in each pass of the torch a number of particle layers are deposited that also create an additional temperature gradient within themselves. The maximum thickness of a given coating that can be deposited is, therefore, a complex function of the coating/substrate bond strength, and those factors affecting residual stress such as the rate of deposition, coefficients of thermal expansion of the coating and substrate, their heat capacities, thermal conductivity, mechanical properties and temperatures before impact, etc. Using conventional plasma deposition techniques, the maximum thicknesses of several types of common coatings on flat surfaces are appoximately:

| | |
|---|---|
| Pure Ni | Over 0.100 inches |
| Ni-20Cr* | 0.020 |
| Co-base alloys in general | 0.015 |
| Stellite 6** | 0.010 |
| LCO-8** | 0.010 |
| WC-12 Co* | 0.015 |
| $Cr_3C_2$-15 (Ni-20Cr)* | 0.015 |
| $Al_2O_3$ | 0.030 |
| $Cr_2O_3$ | 0.012 |

*percent by weight
**defined subsequently

It is common practice to "preheat" a substrate before applying a plasma coating to drive off adsorbed water and gases. This is normally done using the plasma torch itself without powder flowing. The part is not heated to over 150° C. and this practice has little, if any, effect on the residual stress. Recently, we have discovered that by preheating the substrate to higher temperatures, coatings can be deposited that are over five times thicker than can be made under conventional conditions. The preheating in this case is to a substantially higher temperature than the preheating referred to above, and the substrate is maintained at an elevated temperature throughout the coating process. For brevity, this preheating and elevated temperature deposition will be referred to hereinafter as "hot deposition." The minimum temperature that is required for any coating- /substrate combination is usually determined empirically. Hot deposition has been particularly useful for cobalt base alloys, since these materials are very highly stressed under normal deposition conditions.

Moreover, the Russians, Doroyhkin and Kuznetsov, have studied the effect of substrate temperature on the density and bonding of a self-fluxing 80Ni-Cr-3B-Si (exact composition unspecified) coating on a 0.9%–18% Cr steel ("Plasma Spraying of Self-Fluxing Alloys onto Heated Substrates," Poroshkovaya Metallurgiya, No. 12 (144) pp. 51–56, December, 1974). Self-fluxing alloys are normally deposited with thermospray equipment and subsequently fused on the substrate; e.g., with an oxyacetylene torch or by furnacing. The B and Si tend to form a flux that dissolves oxides created during deposition and limits additional oxidation during fusing. These materials have previously been suggested as plasma-deposited coatings, but for use under normal conditions with the substrate temperature limited to about 300° F. (149° C.). Used in this manner they reportedly result in a somewhat denser coating than is normally achieved. This effect is probably due to the lower melting point and higher fluidity caused by the B or Si additions as well as their fluxing characteristics.

Doroyhkin and Kuznetsov reported that by preheating the substrate to over 800° C. coatings with a porosity of less than 2 percent could be achieved. It is important to note that they ascribed this high density to liquid flow on the surface during deposition. They reported continuously increasing coating density with increasing substrate temperatures between 20° and 800° C., but that the coating hardness remained constant. When the substrate temperature exceeded 800° C., the hardness of the coating decreased.

In all of the work discussed so far, the use of substrate preheating and/or hot deposition was to either control residual stress in the coating or increase the coating density, and all of the coatings were conventional solid solution metallic alloys that may or may not have formed intermetallic phases. In the present invention, it has been discovered, however, that for coatings containing carbides, a surprising increase in hardness and wear resistance can be achieved by hot deposition. The substrate is normally preheated to a temperature between 350° and 1000° C. and maintained within that range during deposition. (The exact temperature within this range is a function of the coating and substrate composition.) As a result, a fine precipitate dispersion of carbides is formed in addition to any carbides that might form under normal cold deposition. The specific carbide composition will be, of course, a function of the coating composition. The mechanism of strengthening due to hot deposition is not fully understood, but is apparently associated with the unique microstructure developed. As additional benefits, carbide coatings of greater thickness and with higher deposition efficiencies can, as expected, be made with hot deposition than by conventional techniques.

EXAMPLES

The basic discovery can best be illustrated by comparing the coatings shown in Table I, as set forth below, when deposited "hot" and "cold;" i.e., when deposited after a substantial amount of preheat to the substrate and while the substrate is maintained at the preheated temperature versus when deposited conventionally. The specific hot deposition temperatures were chosen as those necessary to ensure adherence of a 0.040 inch thick coating on a 304 stainless steel (Fe-19Cr-10Ni) substrate. The NiCr + $Al_2O_3$ coatings were an exception to this since a 0.040 inch coating of this material can be deposited at room temperature. The comparative properties of the coatings are shown in Table II, as set forth below, for both as-deposited and heat-treated coatings (to be discussed shortly).

TABLE I

| Coating Designation | Nominal Coating Composition Weight Percent | Temperature, °C. |
|---|---|---|
| 1 | 28Cr-1.1C-1.OSi-4.OW-3.0Fe*-3.0Ni*-Bal Co | 540–590 |
| 2 | 11.5Co-4.OC-Bal W | 370–480 |
| 3 | 10$Al_2O_3$** + 22.5Cr-6.3A1-9Ta-.7Y-.6C-.6Si-Bal Co | 590–700 |
| 4 | 75$Al_2O_3$** + 18.5Cr-Bal Ni | 170–220 |

*maximum
**$Al_2O_3$ present as a mechanical powder mixture with the prealloyed metallic alloy.
Note:
Coating 1 forms predominatly tungsten carbide precipitate; this coating composition is identified commercially as Stellite 6, a trademark of Cabot Corporation; Coating 2 forms tungsten carbides; Coating 3 forms tantalum carbides; Coating 4 forms no carbides. The substrate in all cases was 304 stainless steel (19Cr-10Ni-.08C*-2Mn*-1Si*-Bal Fe).

TABLE II

| Coating | Technique | Before/After 4 hr 1080° C. Heat Treat | Density (g/cc) | % Theoreti- % cal*1 | Hardness (VPN) |
|---|---|---|---|---|---|
| 1 | Standard | Before | 7.5 | 89% | 441 |
| | Standard | After | — | — | 382 |
| | Hot | Before | 8.1 | 97% | 755 |
| | Hot | After | — | — | 443 |
| 4 | Standard | Before | 6.9 | 88% | 277 |
| | Standard | After | 7.0 | 90% | 280 |
| | Hot | Before | 7.3 | 93% | 313 |
| | Hot | After | — | — | 228 |
| 2 | Standard | Before | 12.5 | 84% | 724 |
| | Standard | After | 13.0 | 88% | 786 |
| | Hot | Before | 13.9 | 94% | 1231 |
| | Hot | After | 13.6 | 92% | 1264 |
| 3 | Standard | Before | 6.6 | 90% | 614 |
| | Standard | After*2 | 6.9 | 93% | 505 |
| | Hot | Before | 7.0 | 96% | 948 |
| | Hot | After*3 | 7.0 | 96% | 661 |

*1Theoretical density is taken from the literature for cast or wrought materials.
*2Due to furnace malfunction, heat treatment was actually 4 hours at 1120° C.
*3Due to furnace malfunction, heat treatment was actually 3 hours at 1080° C.

Comparing the properties of the as-deposited coatings, as shown in Table II, it is readily seen that hot deposition significantly increases the hardness of the three carbide forming cobalt base alloy coatings 1, 2 and 3, but not the coating with the solid solution matrix 4. This is true even though the density of the coating 4 increases about the same as coating 3. It should also be noted by comparing 3 and 4 that the $Al_2O_3$ dispersion, although it may improve wear resistance over the matrix alloy, does not influence the response to hot deposition. Examination of the microstructure of the coatings reveals a distinct difference in structure between the hot and cold version of coatings 1, 2 and 3, but not coating 4. In the case of the first three, a metastable, very, very fine precipitate, believed to be carbides (tungsten, tantalum and/or chromium depending on the coating composition) is formed during deposition, but no precipitate is observed in the fourth coating. It should be noted that in coating 2 while the powder consists of tungsten carbide particles in a metallic cobalt matrix, most of the WC present in the powder melts and/or dissolves in the matrix while the powder is in the plasma. On impact the extremely rapid cooling under normal "cold" deposition allows only part of the W to precipitate as WC, an additional amount may precipitate as $W_2C$, $(Co, W)_6C$ or some metastable carbide, but a significant amount appears to remain in solution (at least it cannot be resolved as a precipitate using light optics). A few large particles may be carried completely through the coating process unmelted. In hot deposition, as with coatings 1 and 2, a very fine precipitate forms in addition to those observed after cold deposition. It appears, therefore, that the unique increase in hardness is due to the carbide-forming nature of the coating and the size of the precipitates. While the specific example of coating 2 is that of tungsten carbide with 11.5% Co, similar results would be achieved with the general class of tungsten carbide materials containing from 2% to about 20% Co including those with additives of titanium, tantalum, vanadium, niobium and chromium carbides to the tungsten carbide to increase the mechanical or wear-resistant properties of the tungsten carbide. Such addition can replace up to 20 Wt.% of the tungsten carbide as a mixture or compound with the tungsten carbide or a layer on the tungsten carbide. It is also apparent that similar results would be obtained with other single, mixed or compound carbide systems; e.g., titanium carbide in a nickel matrix, or titanium and tantalum carbides in nickel, cobalt or iron matrices.

It is not necessary with most of the coatings of this invention to use a coating temperature high enough to cause substantial diffusion between the coating and the substrate, indeed such high temperatures during deposition may be detrimental to the hardness of the coating. Nonetheless, for some applications of the coating it may be advantageous to achieve some interdiffusion after coating to improve the bond strength. Shown in Table II are the effects of such a heat treatment (4 hours at 1080° C. in vacuum) on the hot and cold deposited coatings. Again, there is a distinction between coating 4 and the other three. In the case of the carbide forming coatings the hardness either increases or decreases slightly for either hot or cold deposition as a result of the heat treatment, but the hot coatings still remain superior to the cold. In the case of number 4 the cold deposited coating remains unchanged while the hot softens somewhat and there is little difference between the coatings made by the two methods. Thus, hot deposition of carbide forming coatings is advantageous even if they must be heat treated after coating.

Heat treatment can cause substantial changes in the microstructures of coatings whether deposited hot or cold, depending on the time and temperature used. For coatings such as number 4 that are simple dispersions of an insoluble phase such as $Al_2O_3$ in a simple solid solution matrix such as Ni-Cr, no substantial changes occur until the time/temperature parameters are long enough and high enough to allow recrystallization and grain growth. On the other hand, more complex coatings, such as the carbide forming coatings 1, 2, and 3 may undergo further precipitation if deposited cold (or hot if all of the carbon has not been combined) and the carbides tend to form larger particles. This behavior was observed for coating 1, 2 and 3 when given the heat treatment described above. It should be noted, of course, that this single heat treatment may not be the optimum for any of the coatings and that adequate diffusion bonding may be achieved with less loss of hardness at lower heat-treatment temperatures (temperatures lower than about 800° C. are usually not effective in reasonable times, however) and that other thermomechanical treatments may improve the coatings still further.

Further evidence of the efficacy of this invention is shown in Table III below comparing the mechanical properties of coating 3 deposited hot and cold. Hot deposition obviously drastically increases the rupture strength and elastic modulus of the coating. Still further, wear-test results, shown in Table IV, as set forth below, illustrate again the superiority of hot deposition for carbide forming coatings, but not solid solution coatings; i.e., coating 4.

TABLE III

MECHANICAL PROPERTIES OF COATING 3 AS MEASURED IN THE FOUR POINT BEND TEST

| | As-Coated Hot Deposition | As-Coated Standard Deposition |
|---|---|---|
| Rutpure Modulus | 80,700 psi | 54,000 psi |
| ($\sigma$-max) | s* = 7000 psi | s = 6,000 psi |
| Strain to Failure | 2.98 mils/inch | 4.48 mils/inch |
| ($\epsilon$ max) | s = 0.1 mils/inch | s = 0.3 mils/inch |
| Elastic Modulus (E) | $27 \times 10^6$ psi | $12 \times 10^6$ psi |
| | s = $1.5 \times 10^6$ psi | s = $1.9 \times 10^6$ psi |
| Number of Samples Tested | 3 | 2 |

*s = standard deviation

TABLE IV

| Test Conditions | Coating Wear Scar Volume* ($10^{-6}cm^3$) | | | |
|---|---|---|---|---|
| 300# Load | Coating 1** | Coating 4** | Coating 2** | Coating 3** |
| As Coated Block | | | | |
| Hot Deposition | 90 | 100 | 3.4 | Not Tested |
| Standard Deposition | 133 | 33 | 8.3 | Coating Wore Through |
| Heat Treated Block | | | | |
| Hot Deposition | | 3560 | | |
| Standard Deposition | | 1141 | | |
| 450# Load | | | | |
| Hot Deposition | | 1516 | | |
| Standard Deposition | | 163 | | |
| 600# Load | | | | |
| As Coated Block | | | | |
| Hot Deposition | | | 22 | 34 |
| Standard Deposition | | | 31 | Coating Wore Through at 300# Load |
| Heat Treated Block | | | | |
| Hot Deposition | | | | 44 |

TABLE IV-continued

| Test Conditions | Coating Wear Scar Volume* ($10^{-6}cm^3$) | | | |
|---|---|---|---|---|
| 300# Load | Coating 1** | Coating 4** | Coating 2** | Coating 3** |
| Standard Deposition | | | | 153 |

*Wear scar volumes, after 5400 revolutions (at 180 rpm) of 4620 steel rings vs. coated blocks in a block on ring wear test machine using hydraulic fluid identified by U.S. Military Specification MILH5606A. Duplicate tests were run for each set of conditions and results were averaged. The block scar volumes were calculated from projected scar area.
**Compositions listed in Table I.

As a practical application of this invention, combustion engine exhaust valves have been coated with Stellite 6 (see Table V for chemistry) after heating the valve to a specific elevated temperature. A number of different methods of preheating the valve can be used, for example, inductive heating, heating with the plasma device itself without powder flowing, and/or heating with a supplementary oxyacetylene torch. The latter two have both been tried and found to be successful. After preheating the valve to the predetermined minimum temperature for coating, the plasma-deposited material was applied at a feedrate higher than for normal operation (e.g., 60 grams per minute vs. 30 grams per minute). The rate of traverse of the part in front of the plasma device was also much, much slower than normal; for example, 49.5–40.5 inches per minute vs. 10,000 to 20,000 inches per minute for most conventional plasma coatings. The torch itself was traversed across the face to be coated while the valve was rotating to apply a uniform thickness in the area desired. Although various devices have been tested to provide an inert atmosphere during the preheating cycle, as well as the coating cycle, to prevent oxidation of the substrate and coating, it was found that valves can be preheated in air without excessive oxidation and that the coating could be accomplished using only an argon shroud plasma torch as described in U.S. Pat. Nos. 3,470,347 and 3,526,362. It is quite possible that even this shroud can be eliminated with some sacrifice in the purity of the coating.

As specific examples of the technique, auto exhaust valves of the three substrate materials shown in Table V below were coated after preheating to a number of different temperatures to find the minimum temperature at which the valves could be coated without thermal cracking or lifting of the coating. These minimum coating temperatures are listed in Table V below.

TABLE V

| Valve Alloy Type | Nominal Composition | Coeff. of Thermal Exp. | Coating Temp., °C. |
|---|---|---|---|
| Silchrome 10 | 19Cr-8Ni-3Si-1.05Mn-.38C-Bal Fe | $9.6 \times 10^{-6}$/°F. | 570 |
| Silchrome XBC | 20Cr-1.3Ni-2.35Si-.4Mn-.81C-Bal Fe | $6.6 \times 10^{6}$ | 720 |
| Inconel 750 | 15.5Cr-2.5Ti-.7Al-7Fe-Bal Ni | 6.9 to $9.3 \times 10^{-6}$ | 420 |
| 21-2N | 20Cr-8.25Mn-2.1Ni-.55C-.15Si-.3N-.06S | — | 570 |
| Coating | | | |
| Stellite 6 | 28Cr-1.1C-1.0Si-4.0W-3.0Fe*-3.0Ni*-Bal Co | $8.9 \times 10^{-6}$/°F. | |

In all cases, it was found that the temperature could be allowed to increase during the coating operation to a temperature of at least 815° C. without excessive oxidation occurring during deposition. The valve alloys in Table V are both austenitic and ferritic and have coefficients of thermal expansions both greater and smaller than Stellite 6.

In addition to the preceding experiments, another alloy, SAE 1547 (FE-0.22 Si-0.45 C-1.47 Mn), was successfully coated by first preheating the valve to 850° C., but no attempt was made to find the optimum temperature for coating this valve. Similarly, other coatings consisting of Stellite 6 plus 20 weight percent Cr-$Cr_{23}C_6$ and Stellite 6 plus FeCr were applied to the SAE 1547 alloy.

In a more extensive investigation of the coating of exhaust valves made of 21-4 N steel (Fe-9 MN-21 Cr-3.9 Ni-0.4 N-0.2 Si-0.06 S-0.52 C), Stellite 6 (Coating 1) coatings were applied after preheating to temperatures from 650° C. to over 900° C. The temperature of the surface during coating was either held constant during deposition or allowed to increase somewhat. For the coating of this particular alloy, optimum coating parameters for good coating microstructure, hardness, bonding and a minimum of oxidation were found to be preheating to a temperature of 800° C. then coating with continual supplemental heating so that the final temperature was about 1000° C. or maintaining the part at about 800° C. throughout the coating operation. It should be noted that both the 21-4 N and the 21-2 N (Table V) steel valves were coated without difficulty using the methods of this invention whereas applications using either conventional oxyacetylene or transferred plasma-arc hardfacing methods are generally unsuccessful due to outgassing of the fused substrate which causes blistering of the coating. No fusing (melting) of the substrate occurs using the methods of this invention, thus the chromium nitrides or other sources of nitrogen do not release gaseous nitrogen.

As discussed earlier, to improve the bond of the coating to the valve, it may be advisable in some cases to heat treat the part after coating. This was done in the above cases by heating the part in vacuum to a temperature of 1080° C. and holding it for four hours. This kind of thermal treatment may not be necessary for all applications.

To demonstrate the thermal fatigue resistance of these coatings, segments of a ferritic valve (SAE 1547) coated with Stellite 6 plus Cr-$Cr_{23}C_6$ were cycled from 850° C. to room temperature over 300 times with a apparent internal oxidation of the coating or degradation of the interface bond.

BRIEF DESCRIPTION OF THE DRAWINGS

The distinct economic advantage of the present method over oxyacetylene welding for coating exhaust valves is illustrated in the drawings wherein FIGS. 1*a* and 1*b* show the profile of a typical oxyacetylene welded hard-faced engine valve with Stellite 6 before and after grinding, and FIGS. 2*a* and 2*b* show a similar engine valve (but of a different size) coated by the present process. Two things are very evident from the drawing. First, the amount of material that must be removed after the coating operation is far greater with the oxyacetylene method because the profile of the valve cannot be followed as closely as with the plasma deposition. Secondly, the amount of dilution with subsequent loss of properties of the coating is very evident as well with the oxyacetylene technique. In the case of the plasma-deposited material, only enough interdiffusion between the coating and the substrate during heat treatment has occurred to insure a good metallurgical bond.

As another example of the practical application of this invention, a problem with the tips of blades used in the turbine section of gas turbine engines has been addressed. The turbine section is designed with as small a clearance between the tips of the rotating blades and the outer air seal (shroud or surrounding case) as possible to increase the efficiency of the engine. However, as a result of differential heating or cooling rates between the blades and shroud, distortion of the shroud during hard landings, etc., the blade tips actually rub against the shroud at times causing wear of both the blade tip and shroud. Compounding the problem, this wear removes conventional thin (0.003 to 0.007 inches thick) nickel aluminide or MCrAl overlay coatings used to protect the turbine blades from excessive oxidation or corrosion in the hot gases present in this section of the engine. The MCrAl alloys are a family of coatings or overlays with superior corrosion resistance in which M, the base of the alloy, may be Ni, Co, Fe or any combination of these, Cr is present in about 10 to 40 and Al 5 to 20 weight percent, and small amounts (0.3 to 5 percent) of elements such as Y, Hf, Pt, Rh, etc. may be added. Even a fairly light rub between the blade tip and shroud destroys such a thin coating, however, leaving the bare turbine blade exposed. Rapid corrosion of the bare tip widens the clearance between the tip and the shroud, reducing engine efficiency. Such corrosion eventually may destroy a significant portion of the blade, requiring early replacement. Very thick (0.030 to 0.090 inches) coatings of the MCrAl variety were first attempted in an effort to solve this problem, but their creep resistance was inadequate under the high centrifugal force created by the rotation of the blades. In addition, because they were so soft, they tended to smear and gall on the shroud face causing excessive wear.

Coatings of this invention have been shown, however, to have adequate creep resistance and provide corrosion protection as well. Before engine testing, high temperature creep tests were first run to demonstrate the feasibility of the concept. For these creep tests, simulated blade tips were made out of a nickel-base superalloy, preheated to about 590° C., then coated while slowly increasing the temperature to about 815° C. in accordance with the principles of this invention. The specimens were then heat treated for 4 hours at 1080° C. in vacuum as would normally be done with turbine blades. The coatings were made into small bars by cutting off the simulated blade and grinding the coating to 0.75 inches long×0.25 inches wide×0.05 inches to 0.08 inches thick. The bars were tested in three point bending at elevated temperature in air under a static load. The results with several coatings of this invention are compared with a typical conventional MCrAl coating of Co-23 Cr-13 Al-0.65 Y in Table VI below.

TABLE VI

| Coating No. | Coating Composition | Temperature, °C. | Load, psi | Time hr. | Angle of Creep |
|---|---|---|---|---|---|
| 6 | Co-23Cr-13Al-.75Y | 982 | 2000 | 12 | 49.1 |
| 7 | Co-25Cr-7.5Al-10Ta-0.75C-0.75Si-0.75Y | 982 | 2000 | 12 | 2.6 |
| 8* | Coating 7 + 10$Al_2O_3$ | 982 | 2000 | 12 | 1.4 |
| 9 | Coating 7 + 16$Al_2O_3$ | 982 | 2000 | 12 | 1.5 |
| 6 | See above | 1080 | 500 | 12 | >17 |
| 7 | See above | 1080 | 500 | 12 | 2.1 |
| 7 | See above | 1080 | 2000 | 12 | 14.8 |
| 8 | See above | 1080 | 2000 | 12 | 8.2 |
| 8 | See above | 1080 | 2000 | 150 | 17 |
| 9 | See above | 1080 | 2000 | 150 | 8 |
| 10 | 7 + 22 $Al_2O_3$ | 1080 | 2000 | 150 | 5.6 |

*Same as Coating 3 of Table I.

It is obvious by comparing coatings 6 and 7 at either 982° C./2000 psi or 1080° C./500 psi that the coatings of this invention have far greater creep resistance than conventional MCrAl coatings. It is also evident that some additional creep resistance can be obtained by adding an oxide dispersion to the coatings of this invention as shown by comparing coating 7 to coating 8 under the first three test conditions. The longer term stability of coating 8 and additional variants, coatings 9 and 10, are evident after 150 hours at 1080° C. under 2000 psi. The preferred range of $Al_2O_3$ addition is in the range of from 10 Wt.% to 25 Wt.%.

Although all of the foregoing has referred to plasma-deposited coatings, the principles of this invention apply to detonation gun coatings as well. Powders with the same composition as coating 3, with and without the $Al_2O_3$, were deposited using a detonation gun on both a cold substrate (standard deposition) and a "hot" substrate (i.e., preheated to the same range of temperatures) as described above. The hot deposition coatings were found to be harder than the standard and to have microstructural features similar to those described above for hot deposition plasma coatings.

What is claimed is:

1. A method for forming a hard wear-resistant coating on an engine valve made of nitrogen strengthened iron-base alloy which comprises preheating the engine valve to a temperature of from 650° C. to 1000° C., depositing with a plasma or D-gun process a composition consisting essentially of 28 Cr-1.1 C-1.0 Si-4.0 W-3.0 Fe-3.0 Ni-Bal Co, all in wt.% whereby a fine uniform dispersion of carbide particles is found throughout the coating to provide said hard wear-resistant coating.

2. A method for forming hard wear-resistant coatings on metallic substrates which comprises (a) preheating the substrate to a temperature in the range of from 350° to 1000° C., (b) depositing with plasma or D-gun process a composition consisting essentially of 28 Cr-1.1 C-1.0 Si-4.0 W-3.0 Fe-3.0 Ni-Bal Co, all in wt.%, while maintaining such substrates with said temperature range; whereby a fine uniform dispersion of carbide particles is formed throughout the coating to provide said hard wear-resistant coatings.

3. A method for forming hard wear-resistant coatings on metallic substrates which comprises (a) preheating the substrate to a temperature in the range of from 350° C. to 1000° C., (b) depositing with plasma or D-gun process a composition consisting essentially of (25 Cr-7.5 Al-10 Ta-0.75 Y-0.75 C-0.75 Si-Bal Co) plus 10 to 25 $Al_2O_3$, all in wt.%, while maintaining such substrates within said temperature range; whereby a fine uniform dispersion of carbide particles is formed throughout the coatings to provide said hard wear-resistant coatings.

4. A method for forming hard wear-resistant coatings on metallic substrates which comprises (a) preheating the substrate to a temperature in the range of from 350° C. to 1000° C., (b) depositing with a plasma or D-gun process a composition consisting essentially of (25 Cr-7.5 Al-10 Ta-0.75 Y-0.75 C-0.75 Si-Bal Co) plus 16 $Al_2O_3$, all in wt.%, while maintaining such substrates within said temperature range; whereby a fine uniform dispersion of carbide particles is formed throughout the coatings to provide said hard wear-resistant coatings.

5. A method for forming hard wear-resistant coatings on metallic substrates which comprises (a) preheating the substrate to a temperature in the range of from 350° C. to 1000° C., (b) depositing with a plasma or D-gun process, a composition consisting essentially of a mixture of tungsten carbide in at least one other carbide taken from the class consisting of tantalum carbide, titanium carbide, niobium carbide, vanadium carbide and chromium carbide and compounds thereof wherein up to 20 wt.% of the mixture is said other carbide; and 2–20 wt.% is cobalt.

* * * * *